US008047967B1

(12) United States Patent
Teng

(10) Patent No.: US 8,047,967 B1
(45) Date of Patent: Nov. 1, 2011

(54) TRAMPOLINE HAVING A TWO-STAGE FOLDING FUNCTION

(76) Inventor: Ching-Hsien Teng, Shetou Township, Changhua County (TW)

( * ) Notice: Subject to any disclaimer, the term of this patent is extended or adjusted under 35 U.S.C. 154(b) by 0 days.

(21) Appl. No.: 12/790,959

(22) Filed: May 31, 2010

(51) Int. Cl.
*A63B 21/00* (2006.01)

(52) U.S. Cl. ..... 482/27; 482/28; 482/35

(58) Field of Classification Search ..... 482/27, 482/28
See application file for complete search history.

(56) References Cited

U.S. PATENT DOCUMENTS 5,211,498 A * 5/1993 Huang ..... 403/102
5,685,660 A * 11/1997 Liao ..... 403/102
5,730,542 A * 3/1998 Cheng ..... 403/102
6,648,799 B2 * 11/2003 Hall ..... 482/28
7,468,020 B2 * 12/2008 Lai ..... 482/28

* cited by examiner

*Primary Examiner* — Jerome W Donnelly
(74) *Attorney, Agent, or Firm* — Alan Kamrath; Kamrath & Associates PA

(57) ABSTRACT

A trampoline includes a support frame, two pivot mechanisms mounted on the support frame, a bed surrounded by the support frame and a plurality of elastic members biased between the support frame and the bed. The support frame includes a first side rail, a second side rail, a third side rail and a fourth side rail. Thus, the first side rail and the second side rail are moved to abut the third side rail and the fourth side rail to fold the support frame at a first stage, while the first side rail and the fourth side rail are moved toward the second side rail and the third side rail by pivoting the pivot mechanisms to fold the support frame at a second stage so that the support frame is folded in a two-stage manner to reduce the volume of the trampoline largely.

3 Claims, 12 Drawing Sheets

TRAMPOLINE HAVING A TWO-STAGE FOLDING FUNCTION

BACKGROUND OF THE INVENTION

1. Field of the Invention

The present invention relates to an exercising device and, more particularly, to a trampoline.

2. Description of the Related Art

A conventional trampoline in accordance with the prior art shown in FIGS. 10-12 comprises a support frame 50, a plurality of support legs 55 each pivotally mounted on a bottom of the support frame 50, a bed 54 disposed in and surrounded by the support frame 50 and a plurality of elastic members 53 biased between the support frame 50 and the bed 54. The support frame 50 has an annular shape and includes a first side rail 51 and a second side rail 52 pivotally connected with the first side rail 51. The first side rail 51 of the support frame 50 has a substantially semi-circular profile and has two opposite ends each provided with a first pivot portion 511. The second side rail 52 of the support frame 50 has a substantially semi-circular profile and has two opposite ends each provided with a second pivot portion 521 pivotally connected with the respective first pivot portion 511 of the first side rail 51 by a pivot pin 512. In folding of the trampoline, when the second side rail 52 of the support frame 50 is pushed and bent toward the first side rail 51 of the support frame 50, the second pivot portion 521 of the second side rail 52 is pivoted relative to the first pivot portion 511 of the first side rail 51 so that the second side rail 52 of the support frame 50 is moved to abut the first side rail 51 of the support frame 50 so as to fold the support frame 50 and to reduce the volume of the trampoline. However, the folded trampoline still has a larger volume, thereby causing inconvenience to a user in packaging, storage and transportation of the trampoline.

BRIEF SUMMARY OF THE INVENTION

In accordance with the present invention, there is provided a trampoline, comprising a support frame, two opposite pivot mechanisms mounted on the support frame, a bed disposed in and surrounded by the support frame and a plurality of elastic members biased between the support frame and the bed.

The support frame includes a first side rail, a second side rail, a third side rail and a fourth side rail. The first side rail of the support frame has a first end provided with a first pivot portion and a second end provided with a first pivot section. The second side rail of the support frame has a first end provided with a second pivot portion and a second end provided with a second pivot section. The third side rail of the support frame has a first end provided with a third pivot portion and a second end provided with a third pivot section. The fourth side rail of the support frame has a first end provided with a fourth pivot portion and a second end provided with a fourth pivot section. The first pivot portion of the first side rail is pivotally connected with the fourth pivot portion of the fourth side rail, and the second pivot portion of the second side rail is pivotally connected with the third pivot portion of the third side rail. The first pivot section of the first side rail is pivotally connected with the second pivot section of the second side rail by a first one of the pivot mechanisms, and the third pivot section of the third side rail is pivotally connected with the fourth pivot section of the fourth side rail by a second one of the pivot mechanisms. Each of the pivot mechanisms includes two pivot blocks pivoted connected with each other and a protective pad mounted between the two pivot blocks. Each of the pivot blocks of each of the pivot mechanisms has a first end and a second end. The first end of a first one of the pivot blocks is secured on the first pivot section of the first side rail or the third pivot section of the third side rail, and the first end of a second one of the pivot blocks is secured on the second pivot section of the second side rail or the fourth pivot section of the fourth side rail. The first end of each of the pivot blocks has a surface formed with a plurality of through holes to fix a plurality of fixing pins which extends through the first pivot section of the first side rail, the third pivot section of the third side rail, the second pivot section of the second side rail and the fourth pivot section of the fourth side rail. In such a manner, the pivot blocks of the pivot mechanisms are fixed on the first pivot section of the first side rail, the second pivot section of the second side rail, the third pivot section of the third side rail and the fourth pivot section of the fourth side rail by the fixing pins. The second ends of the pivot blocks of each of the pivot mechanisms are pivoted connected with each other by a pivot pin which extends through the protective pad. The protective pad of each of the pivot mechanisms is disposed between the second ends of the pivot blocks and is secured on the pivot pin.

The primary objective of the present invention is to provide a trampoline having a two-stage folding function.

According to the primary advantage of the present invention, the first side rail and the second side rail of the support frame are moved to abut the third side rail and the fourth side rail of the support frame so as to fold the support frame at a first stage, while the first side rail and the fourth side rail of the support frame are moved toward the second side rail and the third side rail of the support frame by pivoting the pivot mechanisms so as to fold the support frame at a second stage so that the support frame is folded in a two-stage manner so as to reduce the whole volume of the trampoline largely, thereby facilitating packaging, storage and transportation of the trampoline.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
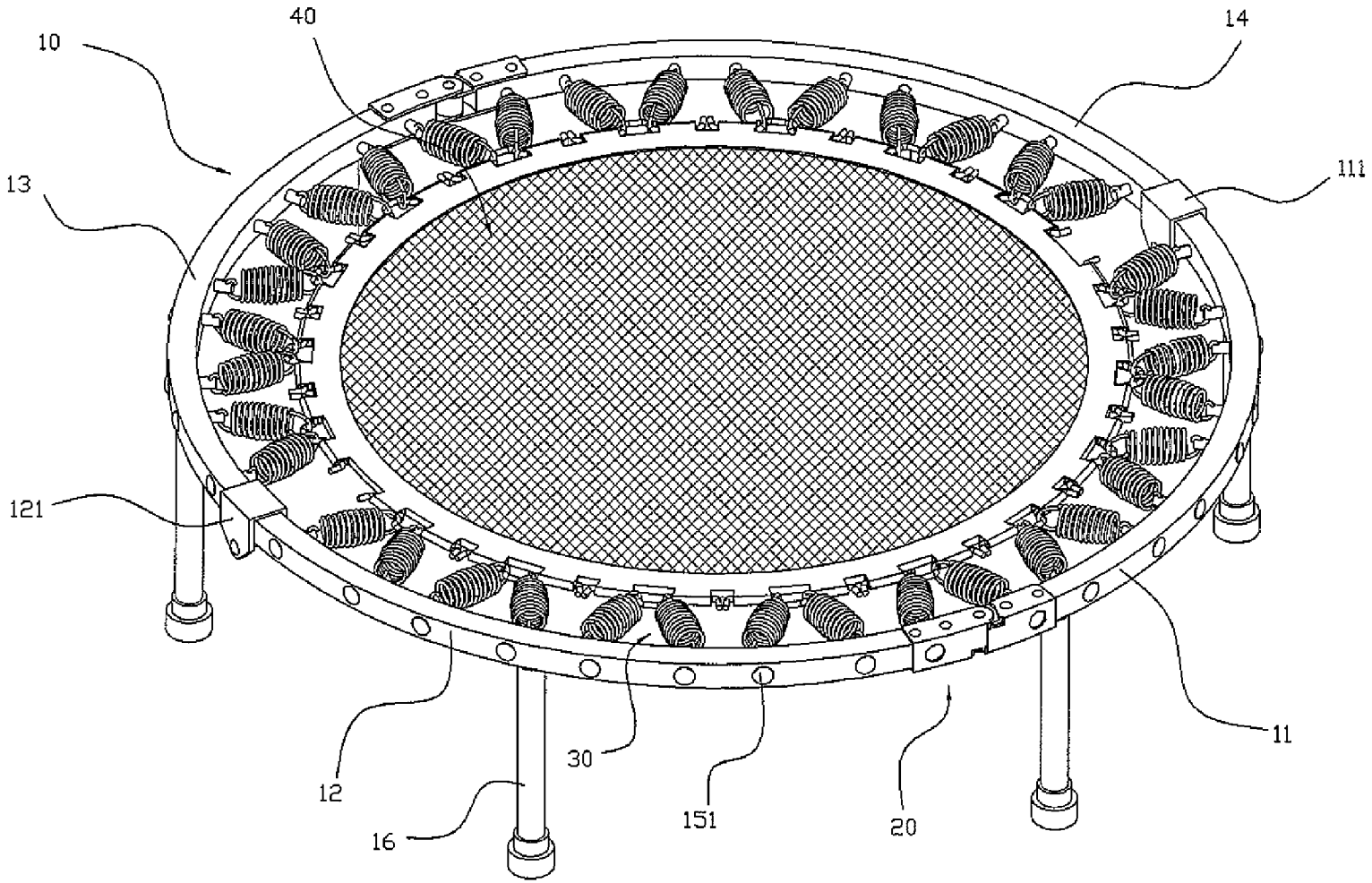
FIG. 1 is a perspective view of a trampoline in accordance with the preferred embodiment of the present invention.
Figure 2:
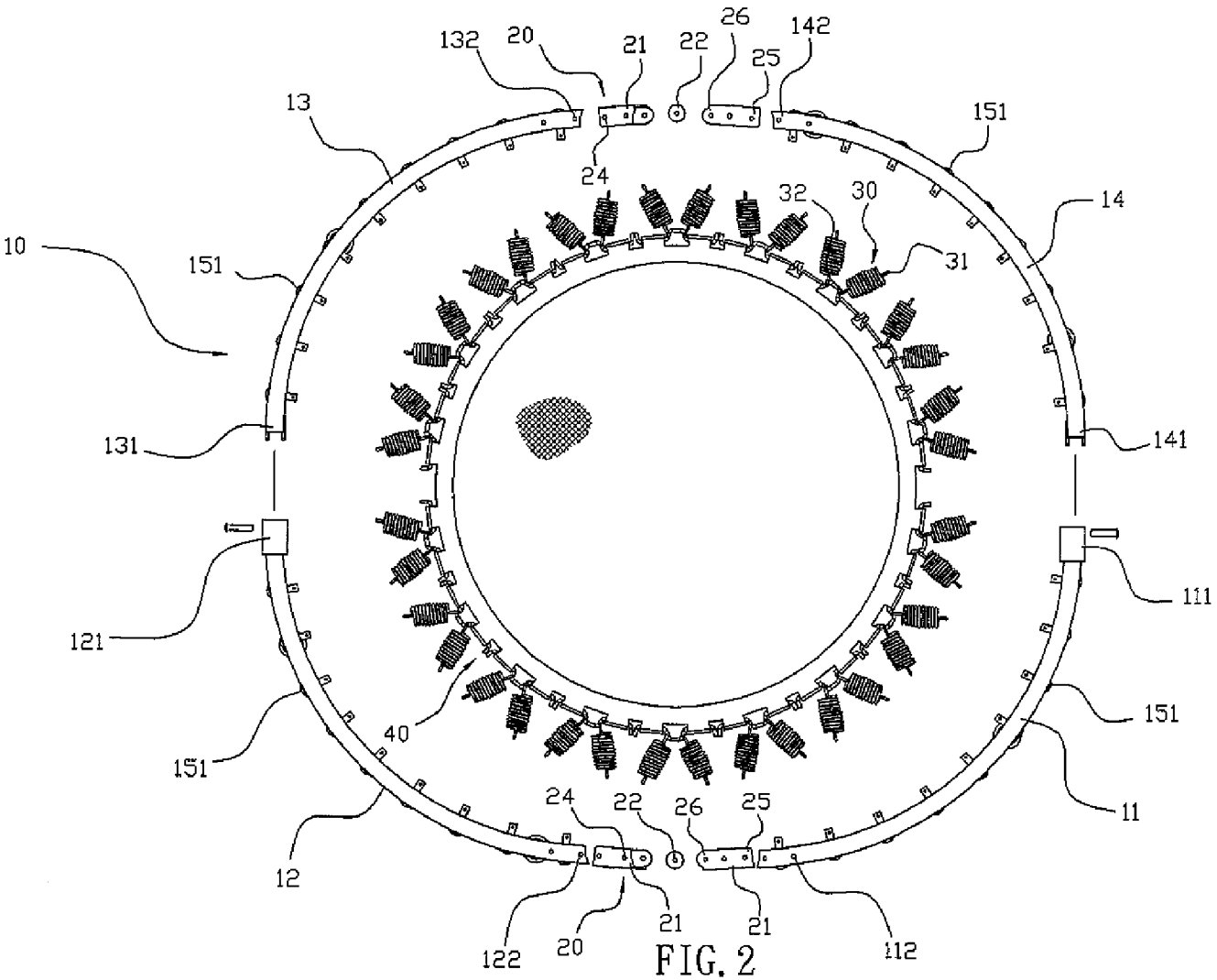
FIG. 2 is a top exploded view of the trampoline as shown in FIG. 1.
Figure 3:
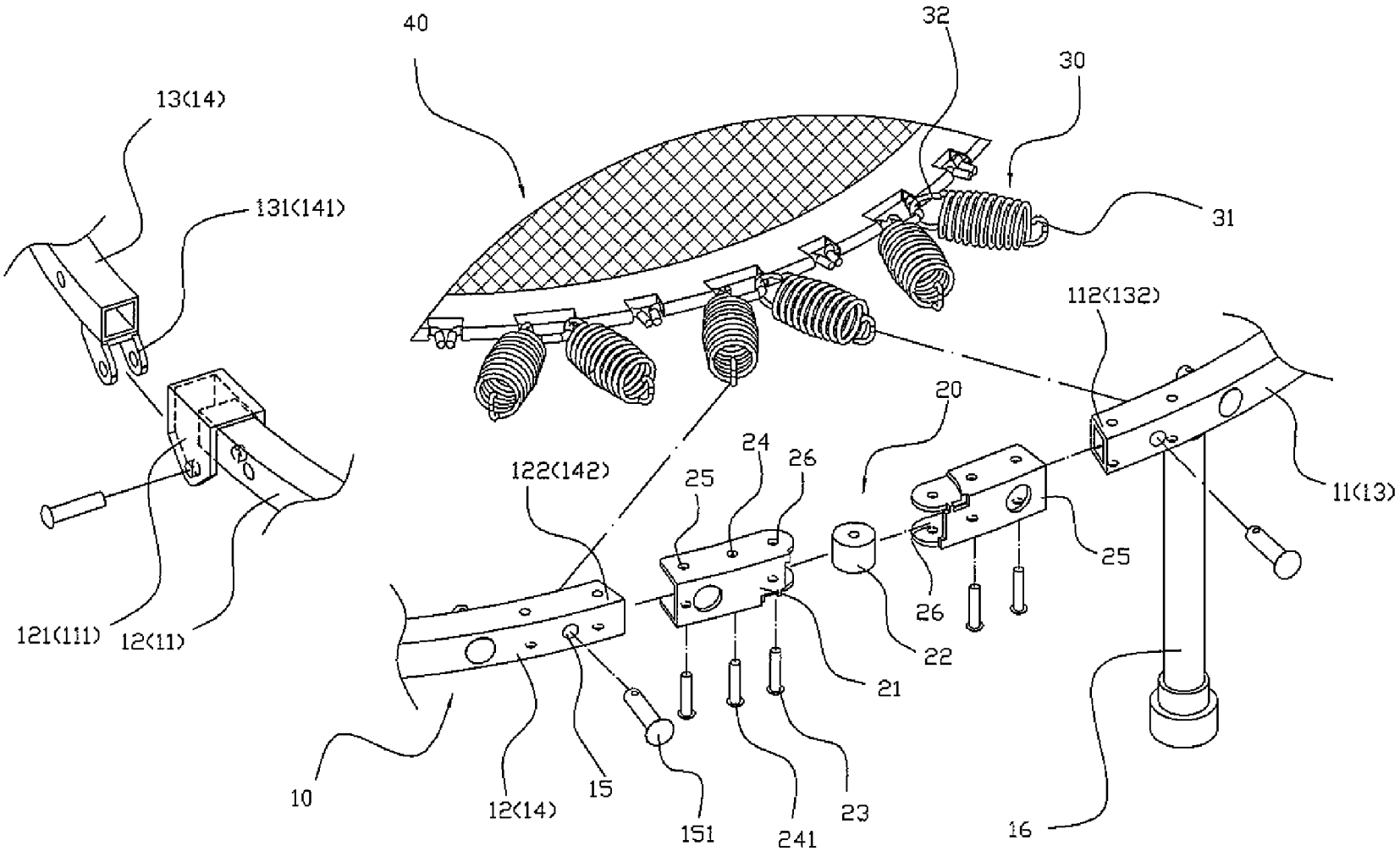
FIG. 3 is a partially exploded perspective view of the trampoline as shown in FIG. 1.
Figure 4:
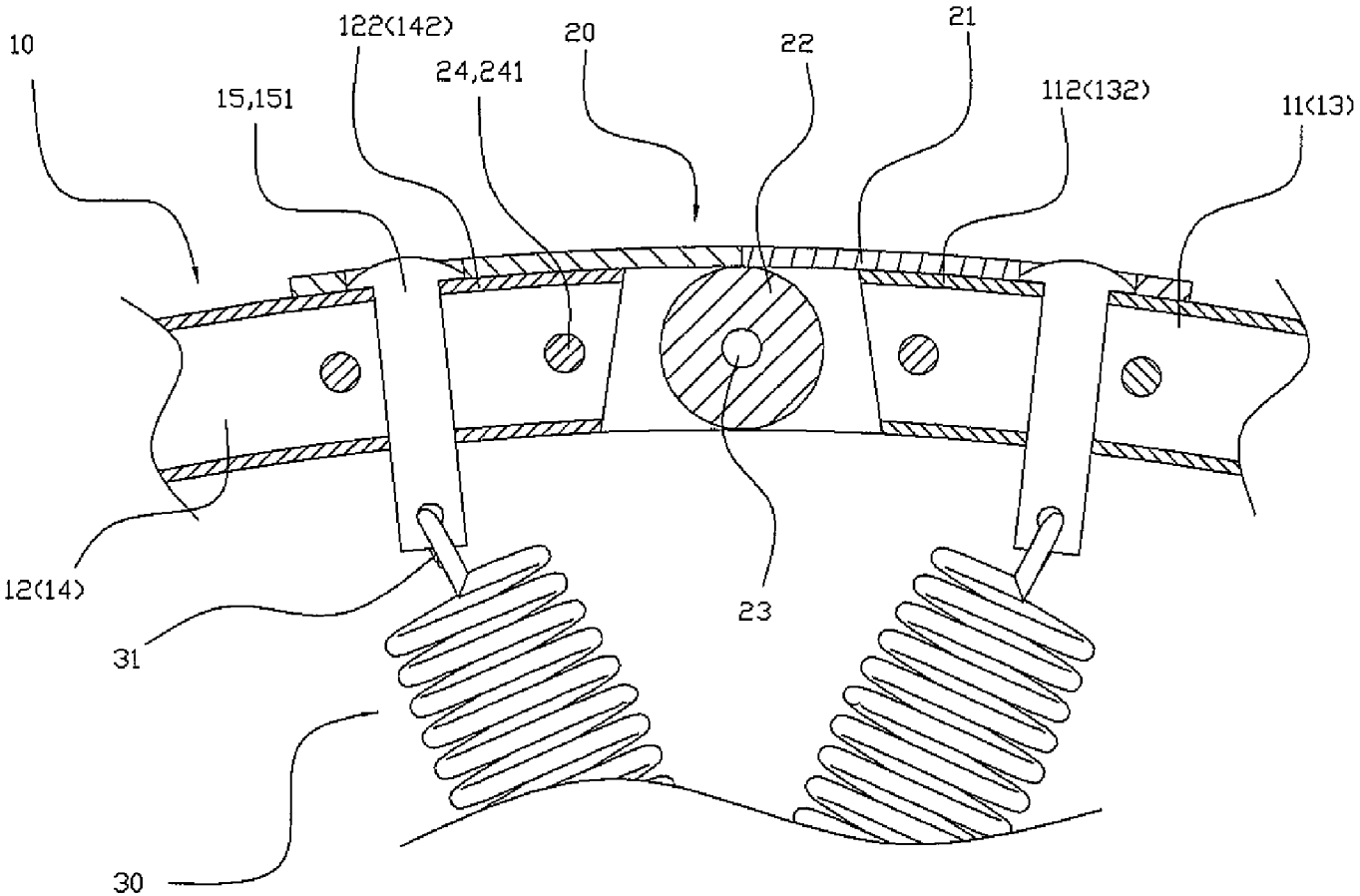
FIG. 4 is a partially top cross-sectional view of the trampoline as shown in FIG. 1.

Referring to the drawings and initially to FIGS. 1-4, a trampoline in accordance with the preferred embodiment of the present invention comprises a support frame 10, a plurality of support legs 16 each pivotally mounted on a bottom of the support frame 10, two opposite pivot mechanisms 20 mounted on the support frame 10, a bed 40 disposed in and surrounded by the support frame 10 and a plurality of elastic members 30 biased between the support frame 10 and the bed 40.

The support frame 10 has an annular shape and includes a first side rail 11, a second side rail 12, a third side rail 13 and a fourth side rail 14. Each of the first side rail 11, the second side rail 12, the third side rail 13 and the fourth side rail 14 of the support frame 10 has a substantially arc-shaped profile. The first side rail 11 and the second side rail 12 of the support frame 10 have the same structure and the opposite direction, while the third side rail 13 and the fourth side rail 14 of the support frame 10 have the same structure and the opposite direction.

The first side rail 11 of the support frame 10 has a first end provided with a substantially U-shaped first pivot portion 111 and a second end provided with a first pivot section 112. The second side rail 12 of the support frame 10 has a first end provided with a substantially U-shaped second pivot portion 121 and a second end provided with a second pivot section 122. The third side rail 13 of the support frame 10 has a first end provided with a third pivot portion 131 and a second end provided with a third pivot section 132. The fourth side rail 14 of the support frame 10 has a first end provided with a fourth pivot portion 141 and a second end provided with a fourth pivot section 142.

The first pivot portion 111 of the first side rail 11 is pivotally connected with the fourth pivot portion 141 of the fourth side rail 14, and the second pivot portion 121 of the second side rail 12 is pivotally connected with the third pivot portion 131 of the third side rail 13.

The first pivot section 112 of the first side rail 11 is pivotally connected with the second pivot section 122 of the second side rail 12 by a first one of the pivot mechanisms 20, and the third pivot section 132 of the third side rail 13 is pivotally connected with the fourth pivot section 142 of the fourth side rail 14 by a second one of the pivot mechanisms 20.

Each of the pivot mechanisms 20 includes two pivot blocks 21 pivoted connected with each other and a protective pad 22 mounted between the two pivot blocks 21. Each of the pivot blocks 21 of each of the pivot mechanisms 20 has a substantially. U-shaped profile and has a first end 25 and a second end 26. The first end 25 of a first one of the pivot blocks 21 is secured on the first pivot section 112 of the first side rail 11 or the third pivot section 132 of the third side rail 13, and the first end 25 of a second one of the pivot blocks 21 is secured on the second pivot section 122 of the second side rail 12 or the fourth pivot section 142 of the fourth side rail 14. The first end 25 of each of the pivot blocks 21 has a surface formed with a plurality of through holes 24 to fix a plurality of fixing pins 241 which extends through the first pivot section 112 of the first side rail 11, the third pivot section 132 of the third side rail 13, the second pivot section 122 of the second side rail 12 and the fourth pivot section 142 of the fourth side rail 14.

In such a manner, the pivot blocks 21 of the pivot mechanisms 20 are fixed on the first pivot section 112 of the first side rail 11, the second pivot section 122 of the second side rail 12, the third pivot section 132 of the third side rail 13 and the fourth pivot section 142 of the fourth side rail 14 by the fixing pins 241.

The second ends 26 of the pivot blocks 21 of each of the pivot mechanisms 20 are pivoted connected with each other by a pivot pin 23 which extends through the protective pad 22. The protective pad 22 of each of the pivot mechanisms 20 has a circular shape. The protective pad 22 of each of the pivot mechanisms 20 is disposed between the second ends 26 of the pivot blocks 21 and is secured on the pivot pin 23.

The support frame 10 has a periphery formed with a plurality of positioning holes 15 to allow passage of a plurality of positioning pins 151. Each of the elastic members 30 has a first end provided with a fixing portion 32 secured on a periphery of the bed 40 and a second end provided with a hooking portion 31 secured on a respective one of the positioning pins 151 on the support frame 10 so that the elastic members 30 are tensioned between the support frame 10 and the bed 40.

Figure 5:
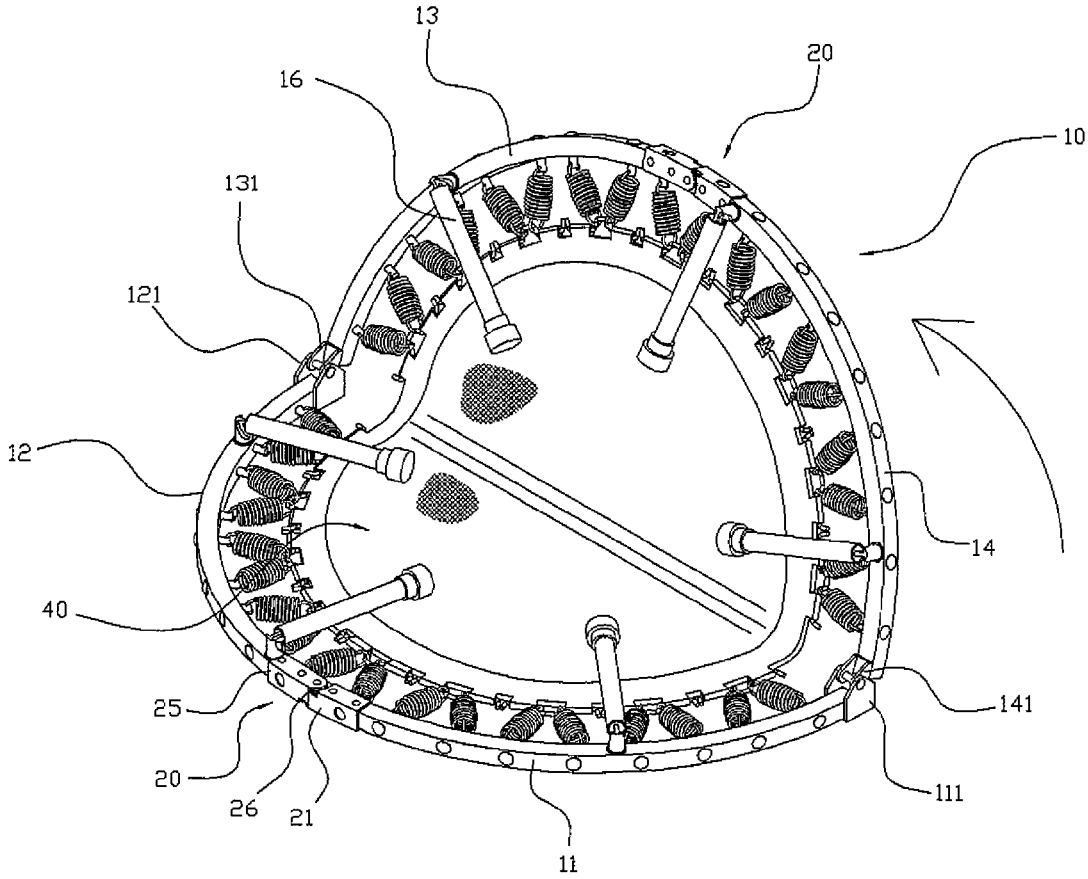
FIG. 5 is a schematic operational view of the trampoline as shown in FIG. 1 in folding.
Figure 6:
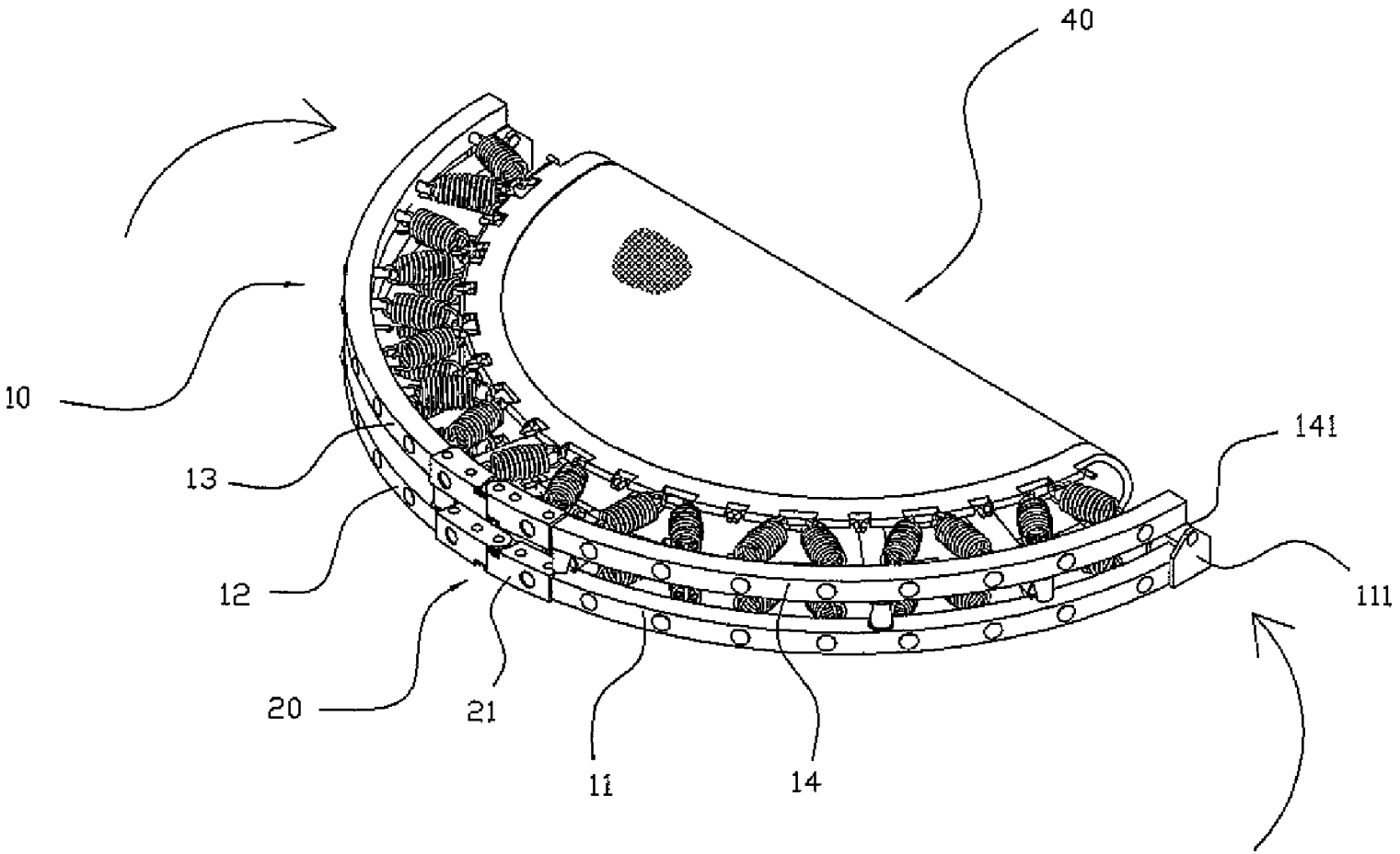
FIG. 6 is a schematic operational view of the trampoline as shown in FIG. 5 in folding.
Figure 7:
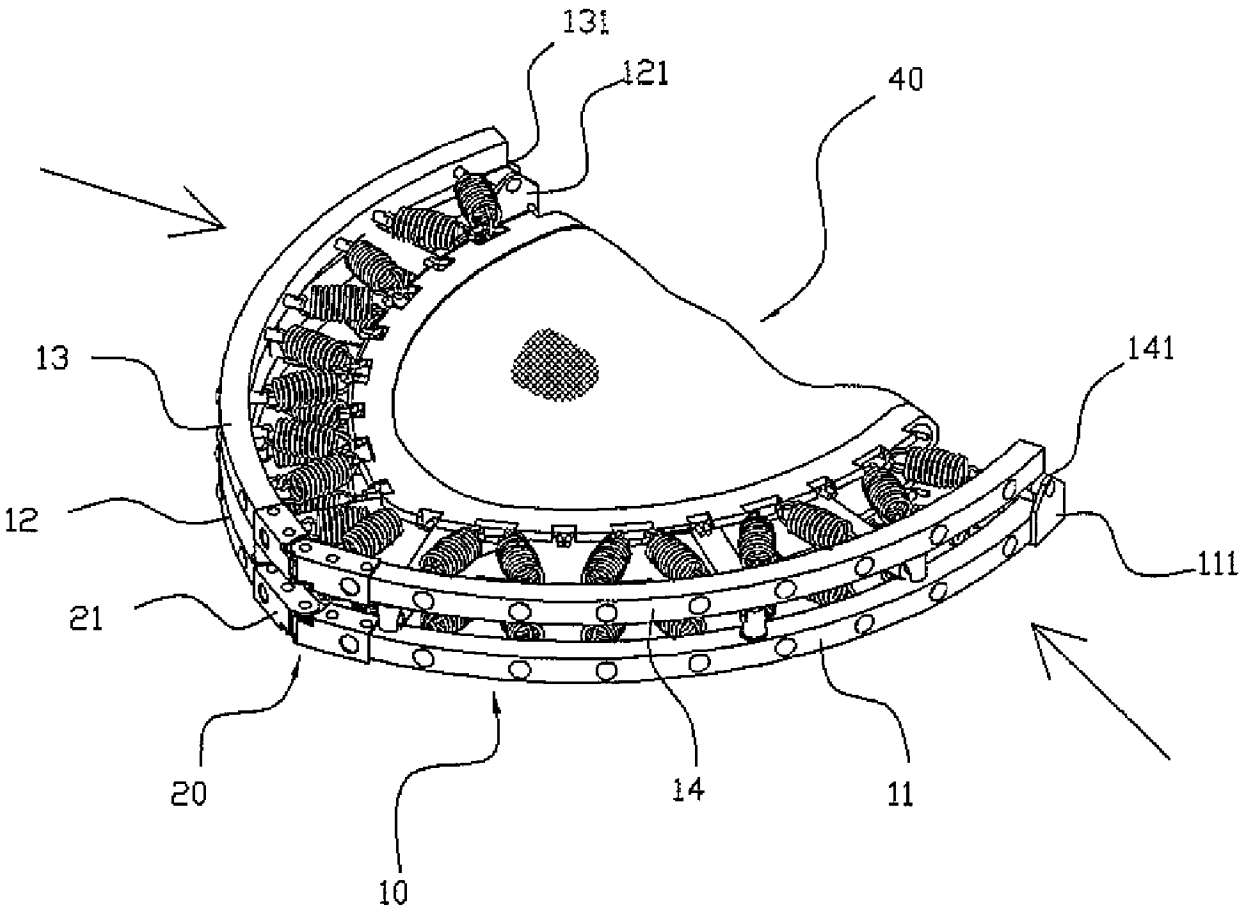
FIG. 7 is a schematic operational view of the trampoline as shown in FIG. 6 in folding.

In folding of the trampoline, referring to FIGS. 5-7 with reference to FIGS. 1-4, when the first side rail 11 and the second side rail 12 of the support frame 10 are pushed and bent toward the third side rail 13 and the fourth side rail 14 of the support frame 10, the first pivot portion 111 of the first side rail 11 is pivoted relative to the fourth pivot portion 141 of the fourth side rail 14, and the second pivot portion 121 of the second side rail 12 is pivoted relative to the third pivot portion 131 of the third side rail 13 as shown in FIG. 5 so that the first side rail 11 and the second side rail 12 of the support frame 10 are moved to abut the third side rail 13 and the fourth side rail 14 of the support frame 10 as shown in FIG. 6 so as to fold the support frame 10 and the bed 40 at a first stage. At this time, the pivot mechanisms 20 are closer to each other. Then, the first side rail 11 and the fourth side rail 14 of the support frame 10 are pushed and bent toward the second side rail 12 and the third side rail 13 of the support frame 10 as shown in FIG. 7 to pivot the pivot mechanisms 20 so that the first side rail 11 and the fourth side rail 14 of the support frame 10 are moved toward the second side rail 12 and the third side rail 13 of the support frame 10 so as to fold the support frame 10 and the bed 40 at a second stage.

Figure 8:
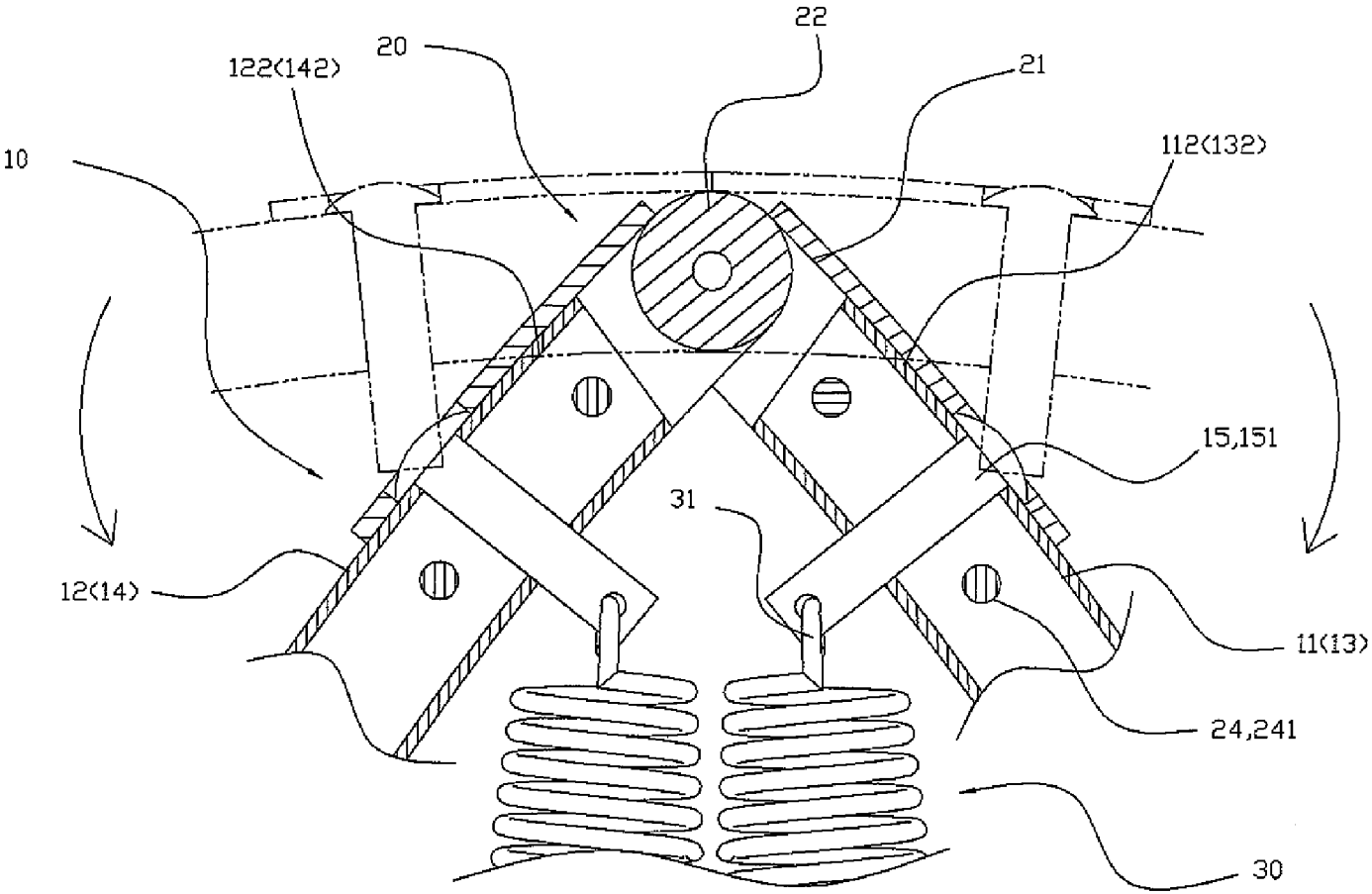
FIG. 8 is a schematic operational view of the trampoline as shown in FIG. 4 in folding.
Figure 9:
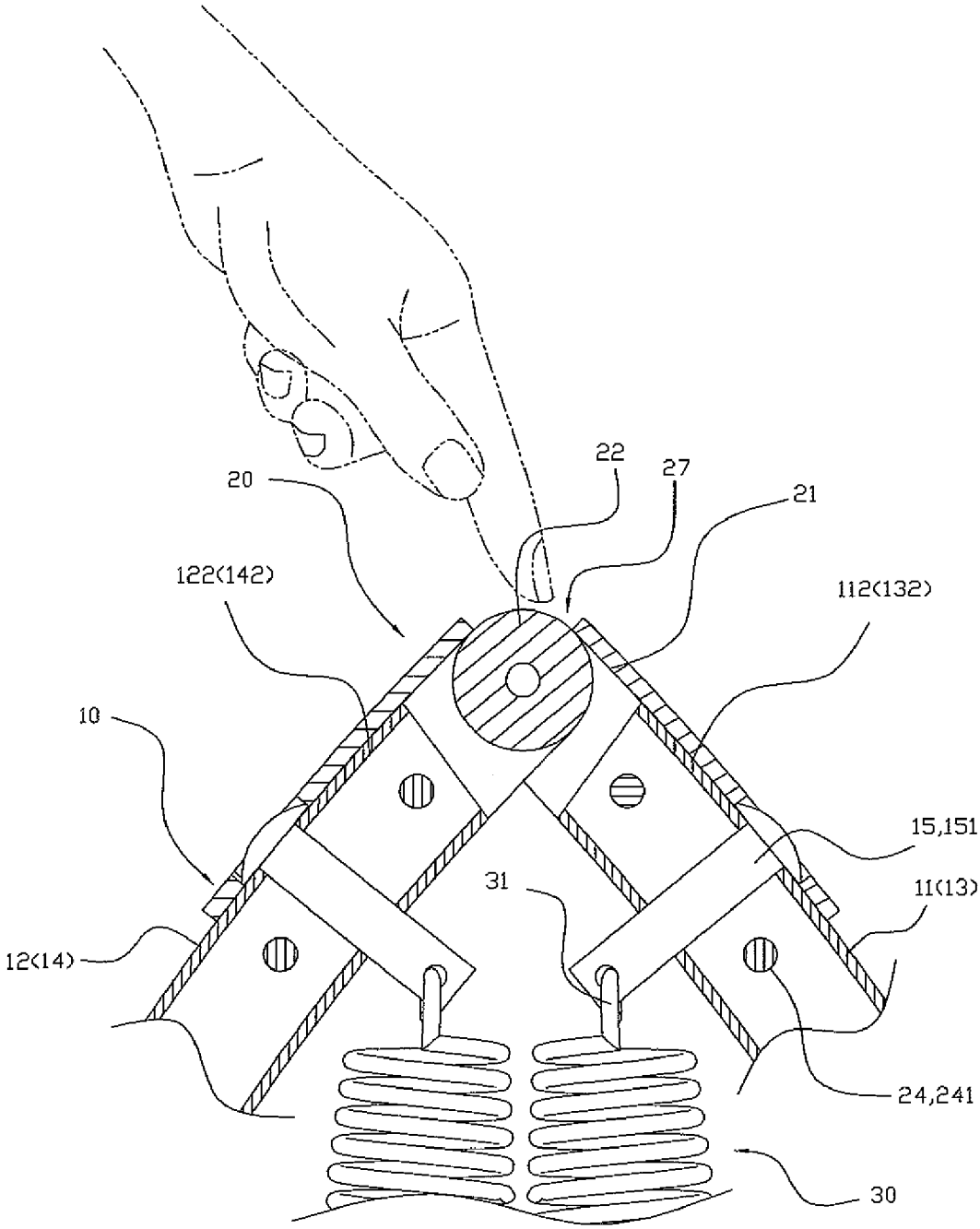
FIG. 9 is a schematic operational view of the trampoline as shown in FIG. 8 in folding.
Figure 10:
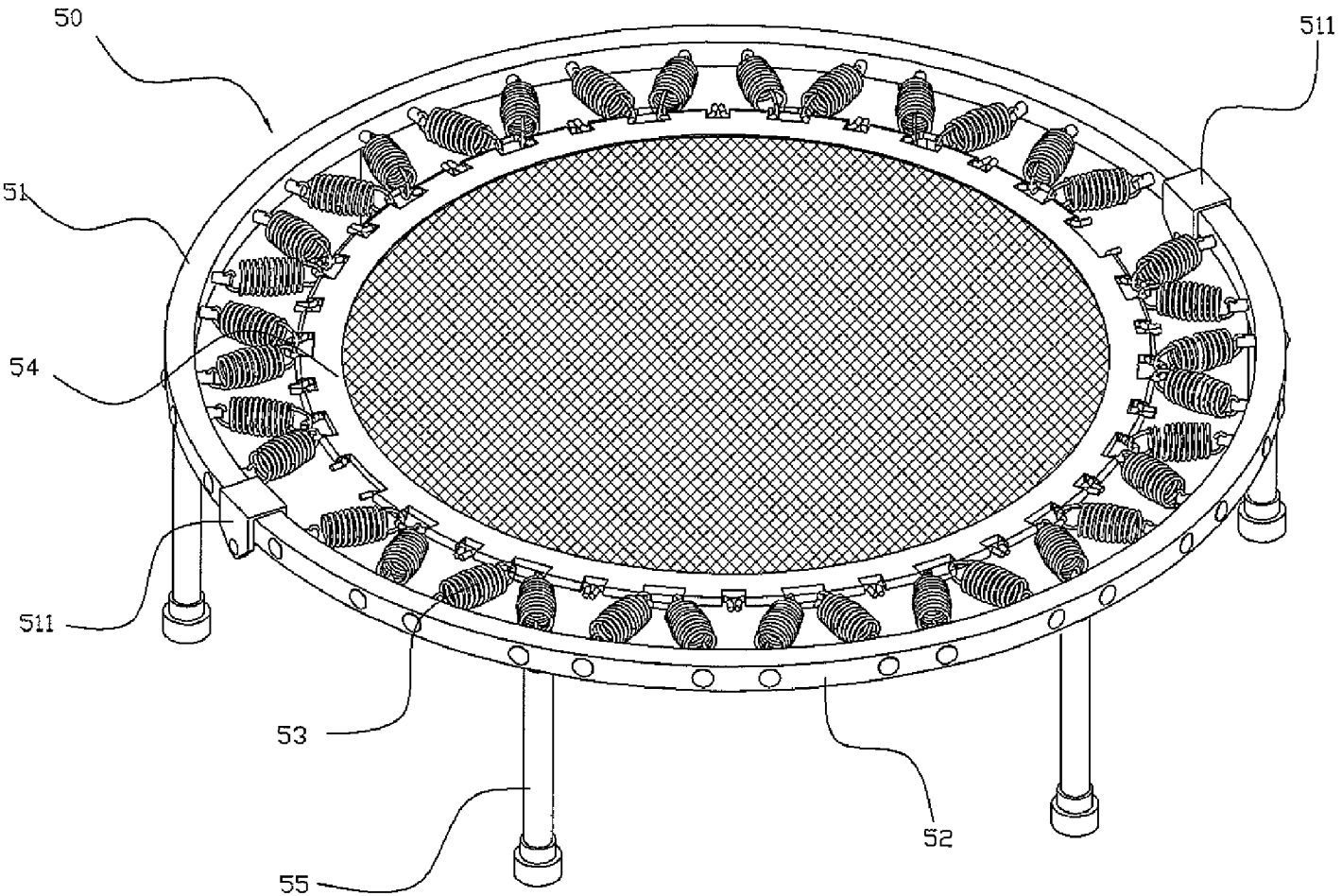
FIG. 10 PRIOR ART
FIG. 10 is a perspective view of a conventional trampoline in accordance with the prior art.
Figure 11:
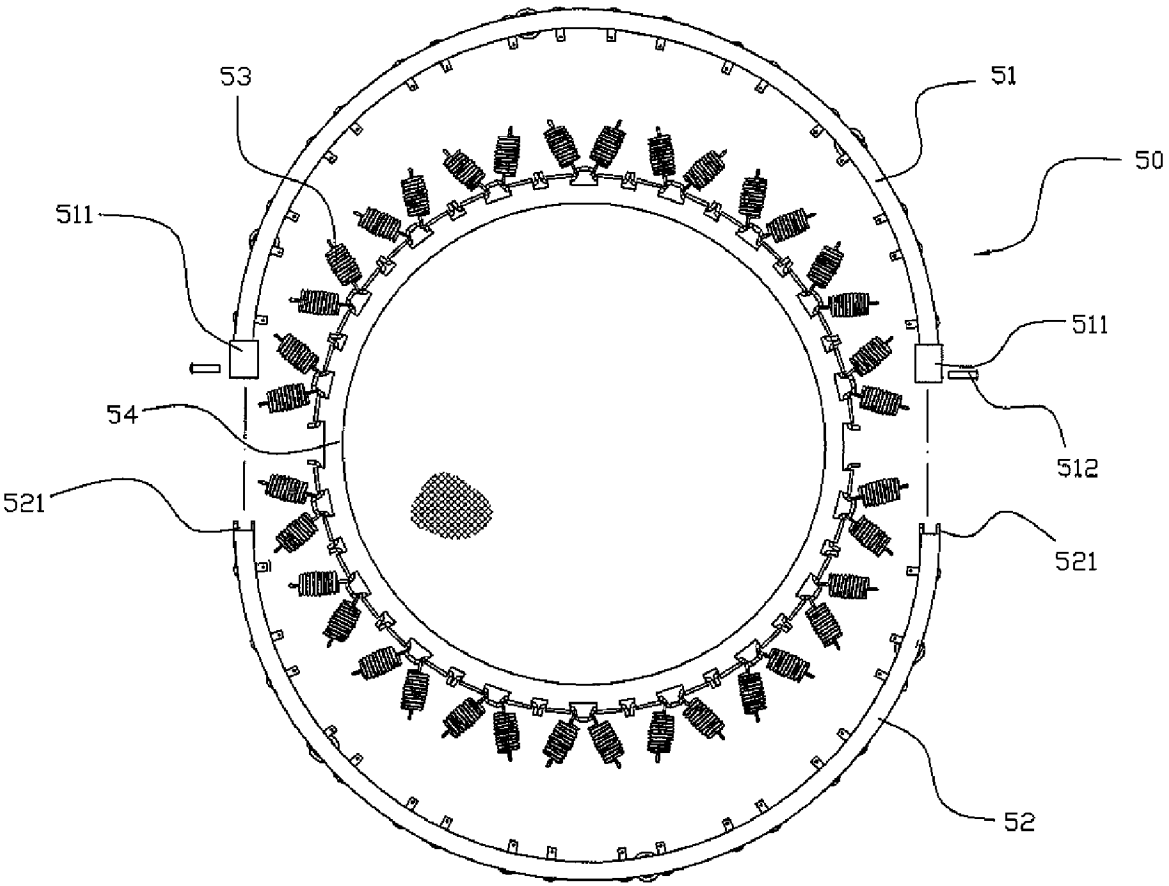
FIG. 11 PRIOR ART
FIG. 11 is a top exploded view of the conventional trampoline as shown in FIG. 10.
Figure 12:
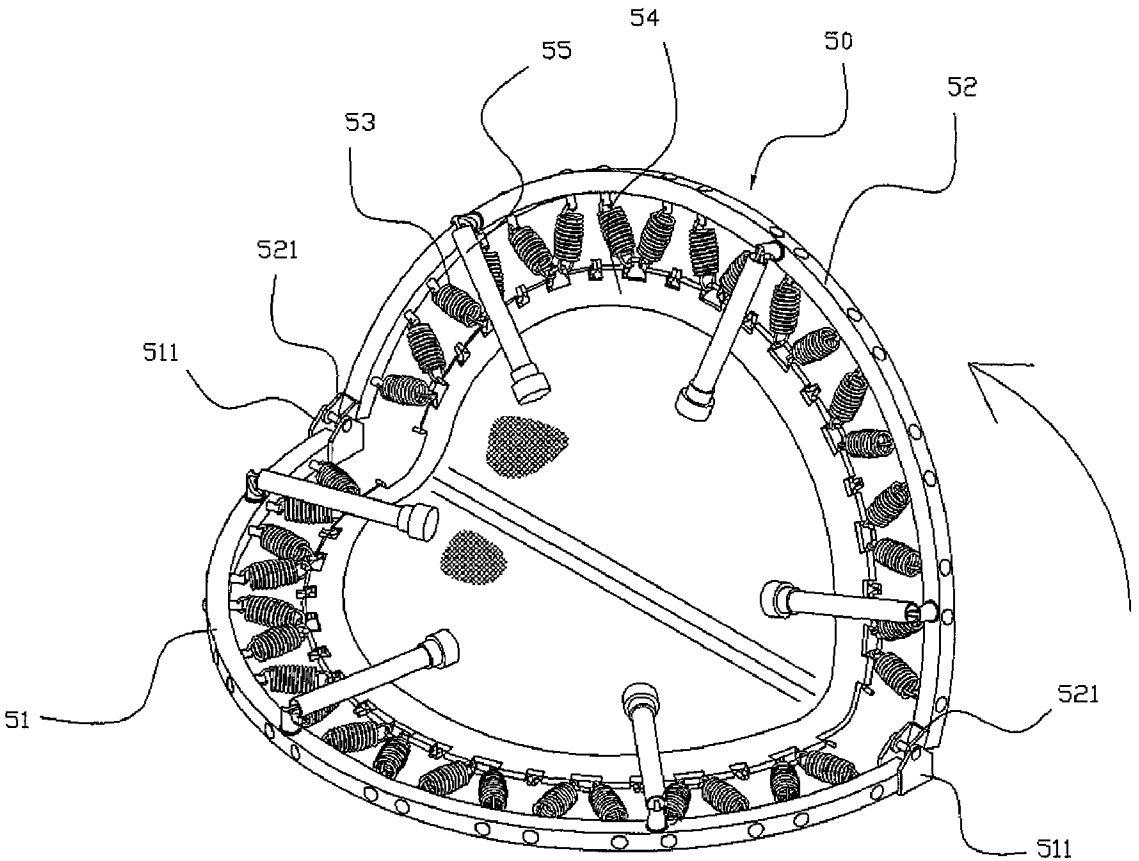
FIG. 12 PRIOR ART
FIG. 12 is a schematic operational view of the conventional trampoline as shown in FIG. 10 in folding.

As shown in FIGS. 8 and 9, when the pivot blocks 21 of each of the pivot mechanisms 20 are pivoted outward relative to each other, the protective pad 22 of each of the pivot mechanisms 20 is exposed outward to block a breach 27 defined between the pivot blocks 21 of each of the pivot mechanisms 20 to prevent a user's finger from being clamped between and hurt by the pivot blocks 21 of each of the pivot mechanisms 20 so as to protect the user's safety.

Accordingly, the first side rail 11 and the second side rail 12 of the support frame 10 are moved to abut the third side rail 13 and the fourth side rail 14 of the support frame 10 so as to fold the support frame 10 at a first stage, while the first side rail 11 and the fourth side rail 14 of the support frame 10 are moved toward the second side rail 12 and the third side rail 13 of the support frame 10 by pivoting the pivot mechanisms 20 so as to fold the support frame 10 at a second stage so that the support frame 10 is folded in a two-stage manner so as to reduce the whole volume of the trampoline largely, thereby facilitating packaging, storage and transportation of the trampoline.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A trampoline, comprising:

a support frame;

two opposite pivot mechanisms mounted on the support frame;

a bed disposed in and surrounded by the support frame; and a plurality of elastic members biased between the support frame and the bed;

wherein the support frame includes a first side rail, a second side rail, a third side rail and a fourth side rail;

the first side rail of the support frame has a first end provided with a first pivot portion and a second end provided with a first pivot section;

the second side rail of the support frame has a first end provided with a second pivot portion and a second end provided with a second pivot section;

the third side rail of the support frame has a first end provided with a third pivot portion and a second end provided with a third pivot section;

the fourth side rail of the support frame has a first end provided with a fourth pivot portion and a second end provided with a fourth pivot section;

the first pivot portion of the first side rail is pivotally connected with the fourth pivot portion of the fourth side rail, and the second pivot portion of the second side rail is pivotally connected with the third pivot portion of the third side rail;

the first pivot portion of the first side rail and the fourth pivot portion of the fourth side rail are pivotable about a first axis that is parallel with the support frame;

the second pivot portion of the second side rail and the third pivot portion of the third side rail are pivotable about the first axis that is parallel with the support frame;

the first pivot section of the first side rail is pivotally connected with the second pivot section of the second side rail by a first one of the pivot mechanisms, and the third pivot section of the third side rail is pivotally connected with the fourth pivot section of the fourth side rail by a second one of the pivot mechanisms;

the first pivot section of the first side rail and the second pivot section of the second side rail are pivotable about a second axis that is perpendicular to the support frame;

the third pivot section of the third side rail and the fourth pivot section of the fourth side rail are pivotable about the second axis that is perpendicular to the support frame;

each of the pivot mechanisms includes two pivot blocks pivotally connected with each other and a protective pad mounted between the two pivot blocks;

each of the pivot blocks of each of the pivot mechanisms has a first end and a second end;

the first end of a first one of the pivot blocks is secured on the first pivot section of the first side rail or the third pivot section of the third side rail, and the first end of a second one of the pivot blocks is secured on the second pivot section of the second side rail or the fourth pivot section of the fourth side rail;

the first end of each of the pivot blocks has a surface formed with a plurality of through holes to fix a plurality of fixing pins which extends through the first pivot section of the first side rail, the third pivot section of the third side rail, the second pivot section of the second side rail and the fourth pivot section of the fourth side rail;

the pivot blocks of the pivot mechanisms are fixed on the first pivot section of the first side rail, the second pivot section of the second side rail, the third pivot section of the third side rail and the fourth pivot section of the fourth side rail by the fixing pins;

the second ends of the pivot blocks of each of the pivot mechanisms are pivotally connected with each other by a pivot pin which extends through the protective pad;

the pivot pin of each of the pivot mechanisms is directed along the second axis that is perpendicular to the support frame;

the pivot blocks of each of the pivot mechanisms are pivotable about the second axis that is perpendicular to the support frame;

the protective pad of each of the pivot mechanisms is disposed between the second ends of the pivot blocks and is secured on the pivot pin.

2. The trampoline of claim 1, wherein the support frame has an annular shape;

each of the first side rail, the second side rail, the third side rail and the fourth side rail of the support frame has a substantially arc-shaped profile;

the first pivot portion of the first side rail has a substantially U-shaped profile;

the second pivot portion of the second side rail has a substantially U-shaped profile;

each of the pivot blocks of each of the pivot mechanisms has a substantially U-shaped profile;

the protective pad of each of the pivot mechanisms has a circular shape;

the support frame has a periphery formed with a plurality of positioning holes to allow passage of a plurality of positioning pins;

each of the elastic members has a first end provided with a fixing portion secured on a periphery of the bed and a second end provided with a hooking portion secured on a respective one of the positioning pins on the support frame so that the elastic members are tensioned between the support frame and the bed;

the trampoline further comprises a plurality of support legs each pivotally mounted on a bottom of the support frame.

3. The trampoline of claim 1, wherein the protective pad of each of the pivot mechanisms is exposed outward to block a breach defined between the two pivot blocks of each of the pivot mechanisms when the two pivot blocks of each of the pivot mechanisms are pivoted outward relative to each other.

* * * * *